US005421046A

United States Patent [19]

Vande Streek

[11] Patent Number: 5,421,046

[45] Date of Patent: Jun. 6, 1995

[54] BED BUMPER PAD

[76] Inventor: Janet L. Vande Streek, 2832 Glenhaven, Kalamazoo, Mich. 49004

[21] Appl. No.: 237,866

[22] Filed: May 4, 1994

[51] Int. Cl.[6] ..... A47D 15/00

[52] U.S. Cl. ..... 5/624; 5/663

[58] Field of Search ..... 5/424, 425, 93.1, 663

[56] References Cited

U.S. PATENT DOCUMENTS

| | | | |
|---|---|---|---|
| 949,389 | 2/1910 | Almgren | 5/93.1 |
| 1,925,637 | 9/1933 | Kellar | 5/425 |
| 3,018,492 | 1/1962 | Rosen | 5/93.1 |
| 3,137,870 | 6/1964 | Fink | 5/93.1 |
| 3,241,158 | 3/1966 | Berl | 5/93.1 |
| 3,321,779 | 5/1967 | Kaufman et al. | 5/93.1 |
| 4,670,923 | 6/1987 | Gabriel et al. | 5/424 |
| 5,044,025 | 9/1991 | Hunsinger et al. | 5/425 X |

*Primary Examiner*—Michael F. Trettel

[57] ABSTRACT

A bed bumper pad comprising a pad having a hollow interior bounded by a pair of spaced and opposed inner and outer side walls with an integral and peripheral edge extended between and around the side walls; a valve mechanism coupled to the pad for allowing the interior thereof to be inflated; and a coupling mechanism for coupling the pad to the rails of a bed.

2 Claims, 4 Drawing Sheets

BED BUMPER PAD

BACKGROUND OF THE INVENTION

1. Field of the Invention

The present invention relates to a bed bumper pad and more particularly pertains to protecting a child from injury due to the rails of a crib and also protecting a person from injury due to the rails of a hospital bed with a bed bumper pad.

2. Description of the Prior Art

The use of bed pads is known in the prior art. More specifically, bed pads heretofore devised and utilized for the purpose of protecting a child or a person from injury due to the rails of a crib or a hospital bed are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,619,824 to Doyle discloses a crib bumper. U.S. Pat. No. 4,767,419 to Fattore discloses a protective pad for crib rail. U.S. Pat. No. 4,800,600 to Gabriel et al. discloses a decorative crib bumper. U.S. Pat. No. 5,010,611 to Mallett discloses a fitted safety crib sheet with integral bumper liner.

While these devices fulfill their respective, particular objective and requirements, the aforementioned patents do not describe a bed bumper pad that is inflatable, formed of a generally transparent material, and adapted for use with a variety of beds such as hospital beds, cribs, and the like.

In this respect, the bed bumper pad according to the present invention substantially departs from the conventional concepts and designs of the prior art, and in doing so provides an apparatus primarily developed for the purpose of protecting a child from injury due to the rails of a crib and also protecting a person from injury due to the rails of a hospital bed.

Therefore, it can be appreciated that there exists a continuing need for new and improved bed bumper pad which can be used for protecting a child from injury due to the rails of a crib and also protecting a person from injury due to the rails of a hospital bed. In this regard, the present invention substantially fulfills this need.

SUMMARY OF THE INVENTION

In the view of the foregoing disadvantages inherent in the known types of bed pads now present in the prior art, the present invention provides an improved bed bumper pad. As such, the general purpose of the present invention, which will be described subsequently in greater detail, is to provide a new and improved bed bumper pad and method which has all the advantages of the prior art and none of the disadvantages.

To attain this, the present invention essentially comprises a first side pad and a second side pad. Each side pad is formed of a generally flexible and transparent material. Each side pad has a hollow interior bounded by a pair of essentially rectangular, spaced, opposed, and upwardly extended inner and outer side walls with opposed top and bottom edges and opposed side edges extended between the side walls to form a peripheral edge. Each side pad has a valve integrally coupled to the outer side wall thereof for allowing the interior to be inflated with air. A head pad and a foot pad are included. Each head and foot pad is formed of a generally flexible and transparent material. Each head and foot pad has a hollow interior bounded by a pair of essentially rectangular, spaced, opposed, and upwardly extended inner and outer side walls with opposed top and bottom edges and opposed side edges extended between the side walls to form a peripheral edge. Each head and foot pad has a valve integrally coupled to the outer side wall thereof for allowing the interior to be inflated with air. A first pair of elongated straps is included. Each strap has a first end and a second end. The second ends of the first pair of straps are coupled to the outer side wall of the first side pad. The first end of one strap of the first pair has a pile type fastener coupled thereto, and the first end of the other strap of the first pair has a complementary pile type fastener coupled thereto. The fasteners of the first pair are adapted to be coupled together in a closed loop configuration around the rails on one side of a crib. A second pair of elongated straps is included. Each strap has a first end and a second end. The second ends of the second pair of straps are coupled to the outer side wall of the second side pad. The first end of one strap of the second pair has a pile type fastener coupled thereto, and the first end of the other strap of the second pair has a complimentary pile type fastener coupled thereto. The fasteners of the second pair are adapted to be coupled together in a closed loop configuration around the rails on the side of a crib opposite the first side pad. A third pair of elongated straps is included. Each strap has a first end and a second end. The second ends of the third pair of straps are coupled to the outer side wall of the head pad. The first end of one strap of the third pair has a pile type fastener coupled thereto, and the first end of the other strap of the third pair has a complimentary pile type fastener coupled thereto. The fasteners of the third pair are adapted to be coupled together in a closed loop configuration around the rails at the head of a crib. Lastly, a fourth pair of elongated straps is included. Each strap has a first end and a second end. The second ends of the fourth pair of straps are coupled to the outer side wall of the foot pad. The first end of one strap of the fourth pair has a pile type fastener coupled thereto, and the first end of the other strap of the fourth pair has a complimentary pile type fastener coupled thereto. The fasteners of the fourth pair are adapted to be coupled together in a closed loop configuration around the rails at the foot of a crib such that the first side pad, second side pad, head pad, and foot pad create a protective rectangular frame for shielding a child placed in a crib from direct contact with its rails.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed bumper pad which has all the advantages of the prior art bed pads and none of the disadvantages.

It is another object of the present invention to provide a new and improved bed bumper pad which may be easily and efficiently manufactured and marketed.

It is a further object of the present invention to provide a new and improved bed bumper pad which is of durable and reliable construction.

An even further object of the present invention is to provide a new and improved bed bumper pad which is susceptible of a low cost of manufacture with regard to both materials and labor, and which accordingly is then susceptible of low prices of sale to the consuming public, thereby making such a bed bumper pad economically available to the buying public.

Still yet another object of the present invention is to provide a new and improved bed bumper pad which provides in the apparatuses and methods of the prior art some of the advantages thereof, while simultaneously overcoming some of the disadvantages normally associated therewith.

Even still another object of the present invention is to provide a new and improved bed bumper pad for protecting a child from injury due to the rails of a crib and also protecting a person from injury due to the rails of a hospital bed.

Lastly, it is an object of the present invention to provide a new and improved bed bumper pad comprising a pad having a hollow interior bounded by a pair of spaced and opposed inner and outer side walls with an integral and peripheral edge extended between and around the side walls; valve means coupled to the pad for allowing the interior thereof to be inflated; and coupling means for coupling the pad to the rails of a bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
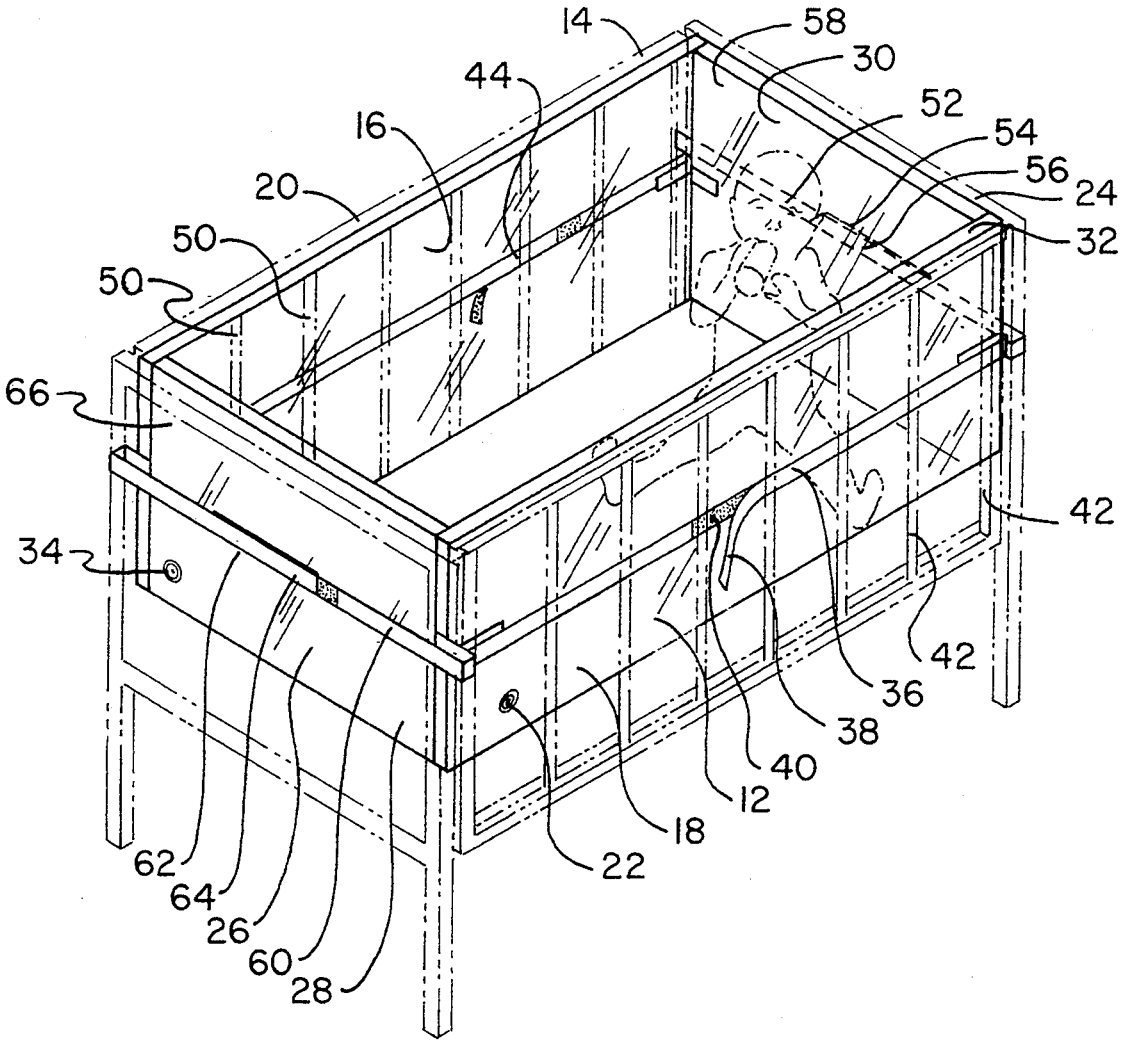
FIG. 1 is a perspective view of the preferred embodiment constructed in accordance with the principles of the present invention extended around the rails of a crib.
Figure 2:
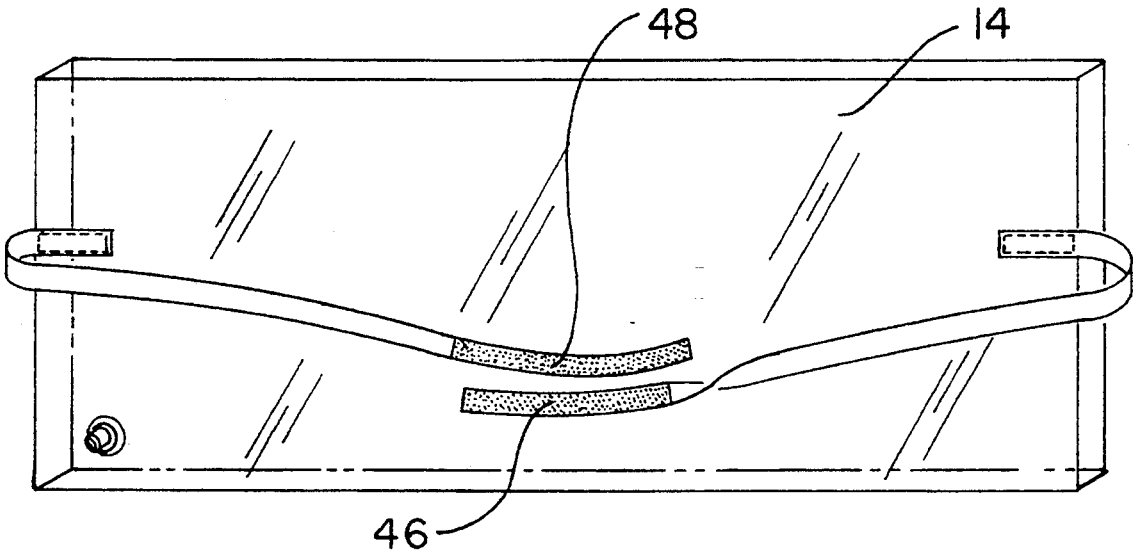
FIG. 2 is a perspective view of the present invention depicting the coupling between the straps and outer side wall of the pad.
Figure 3:
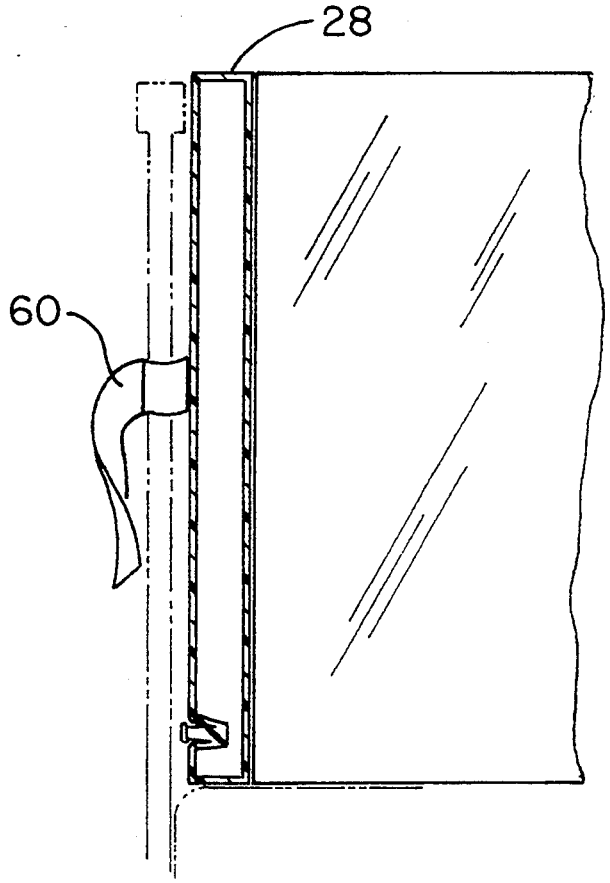
FIG. 3 is a cross sectional view of the present invention positioned adjacent to a rail.

With reference now to the drawings, and in particular, to FIG. 1 thereof, the preferred embodiment of the new and improved bed bumper pad embodying the principles and concepts of the present invention and generally designated by the reference number 10 will be described.

Specifically, the present invention includes 2 major components. The major components are the pads and straps. These components are interrelated to protect a child from injury due to the rails on a crib.

More specifically, it will be noted in the various Figures that the first major component is the pads. The present invention includes a first side pad of 12 and a second side pad 14. A first side pad and a second side pad are proportionately sized. They are also sized with a length and width adapted to fit along and across the rails on the side of a crib. Each side pad is formed of a generally flexible and transparent material. Each side pad has a hollow interior bounded by a pair of essentially rectangular, spaced, opposed, and upwardly extended inner and outer side walls 16, 18. Each side pad also includes opposed top and bottom edges and opposed side edges extended between the side walls to form a peripheral edge 20. The peripheral edge can be formed separately or be an integral part of the side wall combination. Each side pad also has a valve 22 coupled to the outer side wall. The valve is adapted for allowing the interior to be inflated with air.

Furthermore, the present invention includes a head pad 24 and a foot pad 26. The head pad and the foot pad are essentially identical and proportionately sized. They are also sized with a length and width adapted to fit along and across the rails or headboard and footboard of a crib. Each head pad and foot pad are formed of a generally flexible and transparent material. Each head pad and foot pad have a hollow interior bounded by a pair of essentially rectangular, spaced, opposed, and upwardly extended inner and outer side walls 28, 30. Each head pad and foot pad also include opposed top and bottom edges and opposed side edges extended between the side walls to form a peripheral edge 32. The peripheral edge can be formed separately or be an integral part of the side wall combination. Each head pad and foot pad have a valve 34 integrally coupled to the outer side wall. This valve is adapted for allowing the interior to be inflated with air. As can be seen through this description, the head pad, foot pad, first side pad, and second side pad are essentially constructed in the same fashion. However, in most cases, the head pad and the foot pad will each have a length less than the length of each side pad. The length of the pads is essentially dependent on the height and width of the rails disposed about the crib.

The second major component is the straps. The present invention includes a first pair 36 of straps. The straps are elongated in structure. Each strap has a first end and a second end. The second ends of the straps are coupled to the outer side wall of the first side pad 12 near the peripheral edge. The first end of one strap has a pile type fastener 38 coupled thereto. The first end of the other strap has a complimentary pile type fastener 40 coupled thereto. The fasteners are adapted to be coupled together in a closed loop configuration around the rails 42 on one side of a crib.

The present invention includes a second pair 44 of straps. The straps are elongated in structure. Each strap has a first end and a second end. The second ends of the straps are coupled to the outer side wall of the second side pad 14. A first end of one strap has a pile type fastener 46 coupled thereto. The first end of the other strap has a complimentary pile type fastener 48 coupled thereto. The fasteners are adapted to be coupled together in a closed loop configuration around the rails 50 on the side of a crib opposite the location of the first side pad 12 and its coupling with the rails 42 on a crib.

The present invention also includes a third pair 52 of straps. The straps are elongated in structure. Each strap has a first end and a second end. The first ends are coupled to the outer side wall of the head pad 24. The first end of one strap has a pile type fastener 54 coupled thereto. The first end of the other strap has a complimentary pile type fastener 56 coupled thereto. The fasteners are adapted to be coupled together in a closed loop configuration around the rails or head board 58 at the head of a crib.

Lastly, the present invention includes a fourth pair 60 of straps. The straps are elongated and flexible in structure. Each strap has a first end and a second end. The second ends are coupled to the outer side wall of the foot pad 26. The first end of one strap has a pile type fastener 62 coupled thereto. The first end of the other strap has a complimentary pile type fastener 64 coupled thereto. The fasteners are adapted to be coupled together in a closed loop configuration around the rails or the foot board 66 of a crib. The first side pad 12, second side pad 14, head pad 24, and foot pad 26 thus create a protective rectangular frame for shielding a child placed in a crib from direct contact with its rails, headboard, or footboard.

Figure 6:
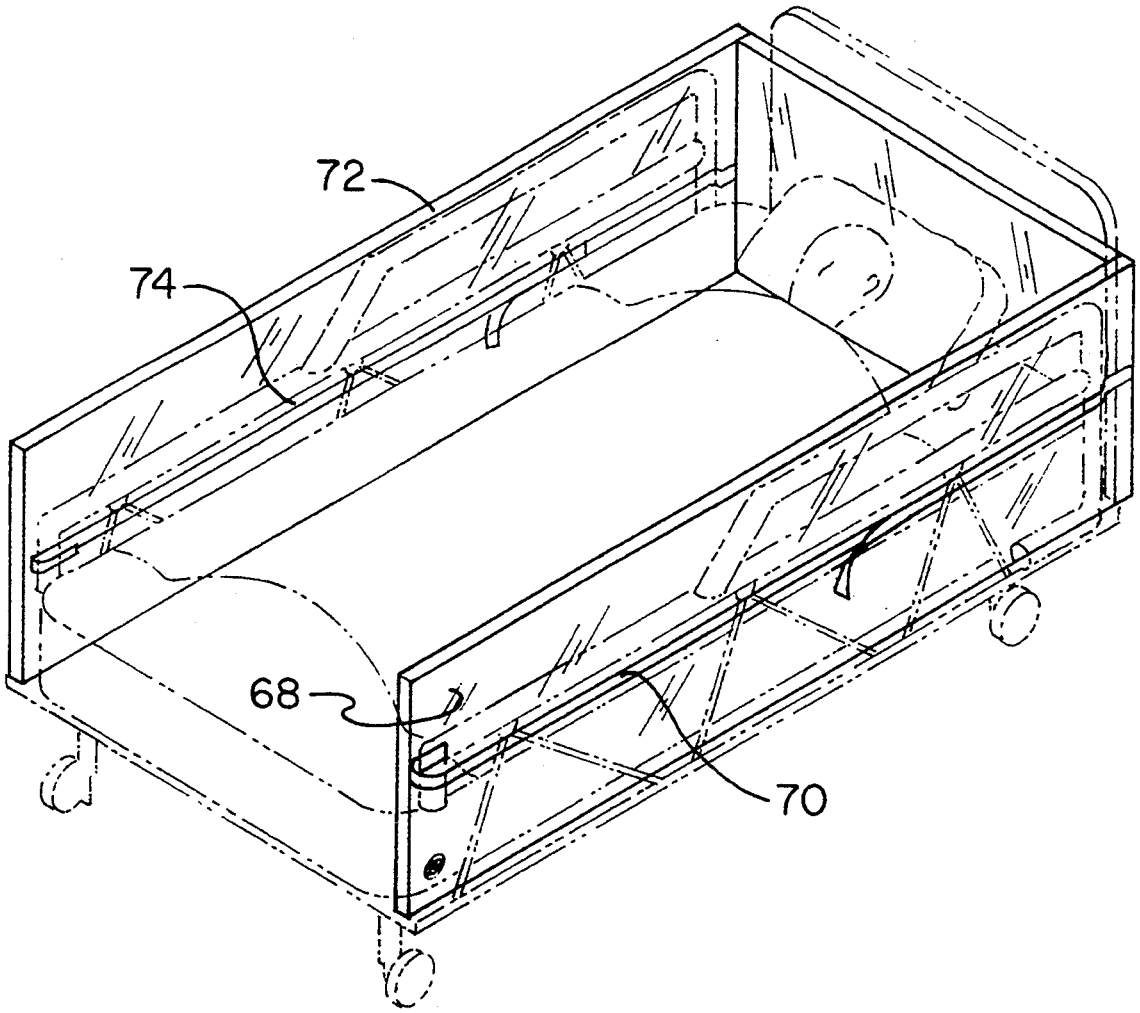
FIG. 6 is a perspective view of an alternate view of the present invention coupled to the rails of a hospital bed.

A second embodiment of the present invention is shown in FIG. 6. This embodiment utilizes a first side pad 68 and accompany first pair of straps 70 and the second side pad 72 and accompanying second pair of straps 74. The first side pad and second side pad in this embodiment are proportionately sized. They are also sized with a length and a width adapted to fit along and across the side rails of a hospital bed. The first side pad is coupled with the first pair of straps to the rails on one side of a hospital bed. The second side pad is coupled with the second pair of straps to the rails on a hospital bed opposite the first side pad. The first side pad and second side pad thus create a protective configuration for shielding a person placed on the hospital bed from direct contact with its rails.

Figure 4:
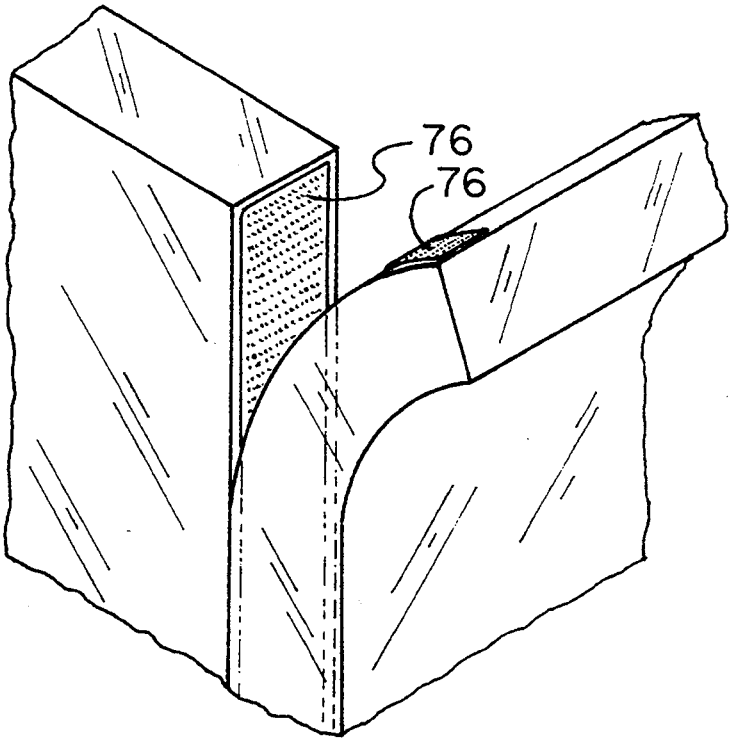
FIG. 4 is an enlarged perspective view of an alternative embodiment of the present invention depicting the coupling means for coupling the pads together near each side edge thereof.
Figure 5:
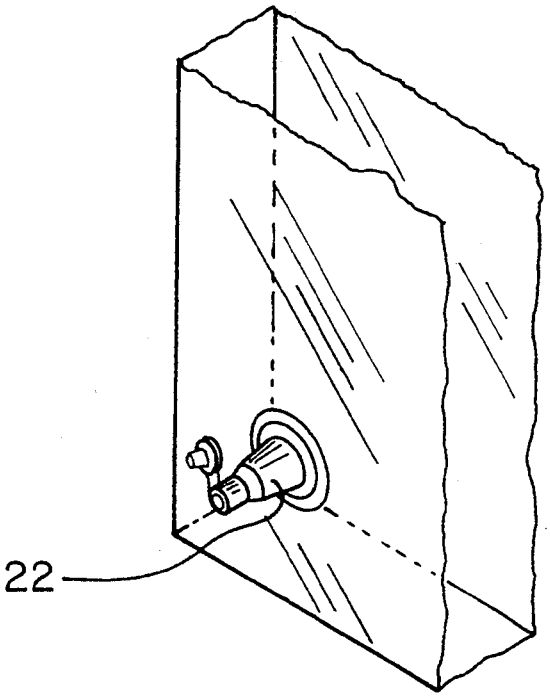
FIG. 5 is an enlarged perspective view of the valve used to inflate the pad of the present invention with air.

Another component may be added to the preferred embodiment to define a third embodiment. This component is shown in FIG. 4. This component consists of a coupling means 76 for coupling a plurality of pads together in an end-to-end configuration. This coupling means takes the form of a pile type fastener and complimentary pile type fastener. A pile type fastener is coupled to a pad near the peripheral edge thereof and a complimentary pile type fastener is coupled to another pad near the peripheral edge thereof. The pads may then be coupled together in an end-to-end configuration. When a plurality of pads are coupled together in an enclosed formation, a protective frame is created. Through the use of the pile type fasteners, the shape of the protective frame is essentially maintained without having to use the accompanying straps on the pads. Therefore, when the pads are utilized with a crib, the straps do not need to be secured around the headboard or footboard or even the side rails. This an important consideration when a user wishes to display the surface and structure of the crib itself or ornamentation disposed on the surface of the crib.

Therefore, the present invention is adapted for use on hospital beds with patients suffering from seizures of some kind. It is also adapted for use in cribs with small children whose lack of balance makes them prone to injuring themselves on the rails of the crib. Unlike prior art conventional protective pads, which cover only one third to one half the rail of a hospital bed, the present invention covers the entire length and width of the railing.

A unique feature of the present invention is the transparent pads. The transparent pads allow nurses to observe a patient's activity without having to walk over and look over the rail of the hospital bed. In a similar fashion, the present invention allows parents to observe their child's activity without having to walk over and look over the rail of the crib. Furthermore, children in cribs equipped with the present invention can observe their surrounding through the transparent pad, which makes them feel less confined and less fearful of their surroundings. The pads of the present invention are constructed of heavy duty vinyl, plastic, or similar polymer-based materials. In any instance, however, the material utilized would also be nontoxic and puncture proof. Therefore, if a child tries to teeth on it, he would not cause injury to the pad or himself. This type of material also enables the pads to be easily washed and disinfected. Translucent materials may also be utilized in lieu of transparent materials for constructing the pads.

The pads of the present invention are also inflatable and deflatable. This allows the present invention to be placed in a minimal configuration for storing. The air valve on the side of the pad is placed in a position facing away from the child or patient. In the home, parents can inflate the pads by using their mouths or by using a conventional pump used to inflate bicycle tires. In a hospital, the pads can be inflated easily by using an adapter and the pressurized air outlet usually present in a patient's room. Other similar gaseous materials besides air could be used to inflate the pads, like nitrogen or carbon dioxide.

The straps of the present invention run lengthwise down the center of the pad. The first end of each strap would be sewn or glued to the pad. The straps may be coupled along the entire length of the rail of a hospital bed or crib or woven through the rails in order to hold the pad in a fixed position. The pads would essentially come in two sizes. One size would be long enough to cover the length of a crib or the rails of a hospital bed. A smaller size would be used for the rails of the head and foot of a crib or hospital bed. When the pads of the present invention are inflated, they are about 1178 to 2 inches thick in order to provide adequate protection.

The present invention is coupled to a hospital bed or crib through the use of velcro pile type fasteners. Alternately, the present invention could be secured to the rails of a hospital bed through the use of a pocket-like sleeve coupled to the outer side wall. The present invention would be provided in sizes adapted to fit along the rails at the sides of a hospital bed and crib as well as the rails at the foot or head of a hospital bed or crib.

Surface ornamentation may be affixed to the surface of the pad. Small pictures of animals, flowers, or cartoon characters could be disposed on the pads. This surface ornamentation would be added to enhance appearance of the pads.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bed bumper pad combination for protecting a child from injury due to the rails of a crib comprising:

a first side pad and a second side pad, each side pad formed of a generally flexible and transparent material, each side pad having a hollow interior bounded by a pair of essentially rectangular, spaced, opposed, and upwardly extended inner and outer side walls with opposed top and bottom edges and opposed side edges extended between the side walls to form a peripheral edge, each side pad having a valve integrally coupled to the outer side wall thereof for allowing the interior to be inflated with air;

a head pad and a foot pad, each head and foot pad formed of a generally flexible and transparent material, each head and foot pad having a hollow interior bounded by a pair of essentially rectangular, spaced, opposed, and upwardly extended inner and outer side walls with opposed top and bottom edges and opposed side edges extended between the side walls to form a peripheral edge, each head and foot pad having a valve integrally coupled to the outer side wall thereof for allowing the interior to be inflated with air;

a first pair of elongated straps with each strap having a first end and a second end, the second ends of both straps coupled to the outer side wall of the first side pad, the first end of one strap having a pile type fastener coupled thereto, and the first end of the other strap having a complementary pile type fastener coupled thereto with the fasteners coupled together in a closed loop configuration around the rails on one side of a crib;

a second pair of elongated straps with each strap having a first end and a second end, the second ends of both straps coupled to the outer side wall of the second side pad, the first end of one strap having a pile type fastener coupled thereto, and the first end of the other strap having a complimentary pile type fastener coupled thereto with the fasteners adapted to be coupled together in a closed loop configuration around the rails on the side of a crib opposite the first side pad;

a third pair of elongated straps with each strap having a first end and a second end, the second ends of both straps coupled to the outer side wall of the head pad, the first end of one strap having a pile type fastener coupled thereto, and the first end of the other strap having a complimentary pile type fastener coupled thereto with the fasteners adapted to be coupled together in a closed loop configuration around the rails at the head of a crib; and a fourth pair of elongated straps with each strap having a first end and a second end, the second ends of both straps coupled to the outer side wall of the foot pad, the first end of one strap having a pile type fastener coupled thereto, and the first end of the other strap having a complimentary pile type fastener coupled thereto with the fasteners adapted to be coupled together in a closed loop configuration around the rails at the foot of a crib such that the first side pad, second side pad, head pad, and foot pad create a protective rectangular frame for shielding a child placed in a crib from direct contact with its rails.

2. A bed bumper pad combination for protecting a person from injury due to the rails of a hospital bed comprising:

a first side pad and a second side pad, each side pad formed of a generally flexible and transparent material, each side pad having a hollow interior bounded by a pair of essentially rectangular, spaced, opposed, and upwardly extended inner and outer side walls with opposed top and bottom edges and opposed side edges extended between the side walls to form a peripheral edge, each side pad having a valve integrally coupled to the outer side wall thereof for allowing the interior to be inflated with air;

a first pair of elongated straps with each strap having a first end and a second end, the second ends of both straps coupled to the outer side wall of the first side pad, the first end of one strap having a pile type fastener coupled thereto, and the first end of the other strap having a complimentary pile type fastener coupled thereto with the fasteners adapted to be coupled together in a closed loop configuration around the rails on one side of a hospital bed; and a second pair of elongated straps with each strap having a first end and a second end, the second ends of both straps coupled to the outer side wall of the second side pad, the first end of one strap having a pile type fastener coupled thereto, and the first end of the other strap having a complimentary pile type fastener coupled thereto with the fasteners adapted to be coupled together in a closed loop configuration around the rails on the side of the hospital bed opposite the first side pad such that the first side pad and the second side pad create a protective configuration for shielding a person placed on the hospital bed from direct contact with its rails.

* * * * *